US012507782B2

(12) United States Patent
Monahan et al.

(10) Patent No.: US 12,507,782 B2
(45) Date of Patent: Dec. 30, 2025

(54) PERSONAL DEFENSE TOOL

(71) Applicant: Susan Monahan, New Haven, CT (US)

(72) Inventors: Susan Monahan, New Haven, CT (US); Eric Cotton, Stratford, CT (US)

(73) Assignee: Susan Monahan, New Haven, CT (US)

( * ) Notice: Subject to any disclaimer, the term of this patent is extended or adjusted under 35 U.S.C. 154(b) by 356 days.

(21) Appl. No.: 18/174,030

(22) Filed: Feb. 24, 2023

(65) Prior Publication Data

US 2023/0270227 A1 Aug. 31, 2023

Related U.S. Application Data

(63) Continuation of application No. 29/868,860, filed on Dec. 15, 2022.

(60) Provisional application No. 63/416,125, filed on Oct. 14, 2022, provisional application No. 63/313,877, filed on Feb. 25, 2022.

(51) Int. Cl.

| | |
|---|---|
| ***A45D 24/14*** | (2006.01) |
| ***A45D 8/12*** | (2006.01) |
| ***A45D 24/02*** | (2006.01) |
| ***F41B 13/00*** | (2006.01) |
| *A45D 24/00* | (2006.01) |

(52) U.S. Cl.

CPC ..... *A45D 24/14* (2013.01); *A45D 8/12* (2013.01); *A45D 24/02* (2013.01); *F41B 13/00* (2013.01); *A45D 2024/002* (2013.01)

(58) Field of Classification Search

CPC ..... F41B 15/08; F41B 13/00; A45D 24/14; A45D 2024/002; A01M 29/00; A01M 29/30; A01M 29/34; A01K 13/002

See application file for complete search history.

(56) References Cited

U.S. PATENT DOCUMENTS 2,199,282 A * 4/1940 Condron ..... A45D 24/14 132/149
3,145,718 A * 8/1964 Pigo ..... A45D 24/14 132/148

(Continued)

FOREIGN PATENT DOCUMENTS

CN 202104410 U 1/2012
CN 106490778 A 3/2017

(Continued)

OTHER PUBLICATIONS

Free3d "Knuckle duster 3D Model" (A downloadable 3D model) [online]. Retrieved from the Internet: https://free3d.com/3d-model/wolverine-claws-5958.html (Year: 2017).*

(Continued)

*Primary Examiner* — Eric J Rosen
*Assistant Examiner* — Luis Ruiz Martin
(74) *Attorney, Agent, or Firm* — Womble Bond Dickinson (US) LLP

(57) ABSTRACT

A personal defense tool has a secondary function as a hair styling tool. The personal defense tool includes a handle portion for grasping by a user's hand or fingers, and a plurality of prongs extending from the handle portion. The prongs are configured to puncture a skin surface of an attacker while also being configured to comb or be retained within a user's hair.

15 Claims, 11 Drawing Sheets

(56) References Cited

U.S. PATENT DOCUMENTS

| | | | | |
|---|---|---|---|---|
| 4,566,472 | A * | 1/1986 | Mueller | A45D 24/22 401/268 |
| 5,437,293 | A * | 8/1995 | Colon | A45D 24/22 132/125 |
| 5,829,643 | A | 11/1998 | Isabella | |
| 5,927,291 | A * | 7/1999 | Beall | A45D 8/12 132/145 |
| 6,427,702 | B1 * | 8/2002 | Silva | A45D 8/12 132/275 |
| D500,546 | S | 1/2005 | Anderson | |
| D510,121 | S | 9/2005 | Blair | |
| 7,231,925 | B1 * | 6/2007 | Wall | A45D 24/02 132/156 |
| 8,839,521 | B2 | 9/2014 | Hazard | |
| D726,969 | S | 4/2015 | Sato et al. | |
| D812,813 | S * | 3/2018 | Stephenson | D28/22 |
| 10,449,683 | B2 | 10/2019 | Spencer et al. | |
| 11,027,439 | B2 | 6/2021 | Levine et al. | |
| 2005/0199255 | A1 | 9/2005 | Silva | |
| 2006/0090770 | A1 | 5/2006 | Wall | |
| 2009/0065015 | A1 * | 3/2009 | Tran | A45D 24/00 132/219 |
| 2012/0037176 | A1 * | 2/2012 | Ito | A45D 24/36 132/200 |
| 2012/0192427 | A1 * | 8/2012 | Hazard | A45D 24/36 132/200 |
| 2013/0047317 | A1 * | 2/2013 | Hanover | F41H 1/04 2/209.12 |
| 2015/0320172 | A1 * | 11/2015 | Spencer | B26B 21/12 30/30 |
| 2017/0280837 | A1 | 10/2017 | Simkin-Brocato | |
| 2017/0355090 | A1 * | 12/2017 | Spencer | B26B 21/4006 |
| 2023/0157431 | A1 * | 5/2023 | Uzochukwu | A45D 34/042 132/114 |
| 2023/0270227 | A1 * | 8/2023 | Monahan | A45D 24/02 132/148 |

FOREIGN PATENT DOCUMENTS

| | | | |
|---|---|---|---|
| CN | 206079464 | U | 4/2017 |
| CN | 306931485 | | 11/2021 |
| CN | 307466479 | | 7/2022 |
| DE | 3934342 | A1 | 4/1991 |
| FR | 903904002 | | 6/1990 |
| GB | 2012970 | B | 2/1991 |
| KR | 3008360100000 | | 1/2016 |
| KR | 3010843060000 | | 11/2020 |

OTHER PUBLICATIONS

Balistas, Knuckle Duster with Black Spikes, Sep. 14, 2022, 4 pages.
Barber Salon, Donna Afro Twist Comb, Aug. 9, 2022, 3 pages.
Bigstock, Iron Brass Knuckles with Spikes, Sep. 14, 2022, 3 pages.
BUDK, Black Cat Self Defense Keychain, Sep. 14, 2022, 5 pages.
Ewa Bochen, Knuckle Comb, Aug. 10, 2022, 3 pages.
Hala Craft, Art Nouveau Ginko Hair Comb, Aug. 9, 2022, 11 pages.
Indus International, K 10 Self Defense Knuckle, Sep. 14, 2022, 5 pages.
Jean Pierre FUSIL, Black knuckle-duster with peaks, Sep. 14, 2022, 5 pages.
Kombativ, Black Spiked Knuckles, Sep. 14, 2022, 4 pages.
Kombativ, Black Steel Claws, Sep. 14, 2022, 4 pages.
Kombativ, Brass Tiger Claws, Sep. 14, 2022, 4 pages.
Liu Jun, Stainless Steel Rings Geometric knuckles Simple Hidden Cool Silver Rings for Men Women, Sep. 14, 2022, 8 pages.
Pantera, Pantera Fantasy Dagger Claw Knife, https://www.swordsknivesanddaggers.com/pantera-fantasy-dagger-claw-knife/, Sep. 14, 2022, 4 pages.
Sarah, Tiger Claw Four Finger Brass Knuckle Ring, Sep. 14, 2022, 2 pages.
Superhero Claws, Sep. 14, 2022, 9 pages.
Tactical Gears, Heavy Steel Knuckles with Spikes, Sep. 14, 2022, 5 pages.
TigerLady, Women's Self Defense-Natural scratching tool for women's safety, Sep. 14, 2022, 5 pages.
Wish, Knuckles Punch, Sep. 14, 2022, 2 pages.

* cited by examiner

PERSONAL DEFENSE TOOL

CROSS-REFERENCE TO RELATED APPLICATIONS

This application claims the benefit of and priority to U.S. design patent application No. 29/868,860 filed Dec. 15, 2022, U.S. Provisional Patent Application No. 63/416,125 filed Oct. 14, 2022, and U.S. Provisional Patent Application No. 63/313,877 filed Feb. 25, 2022, the entire contents of each of which being incorporated by reference herein.

BACKGROUND

There has been a steady increase in violence against others. Such violence may include physical or sexual attacks. It is believed that violence against women and children is the most common form of violence in the undeveloped or developed countries, such as the United States. However, there has also been a steady increase in violence against men. For example, violence within the gay male community has been on the rise, as well as violence against straight men by their significant other.

Since attackers typically prey on those whom they think have little to no ability to defend themselves, several self-defense tools have been promoted for helping to prevent these attacks and help potential victims and actual victims defend themselves. One such self-defense tool is a firearm; however, many people are reluctant to own or use a firearm even if their own lives are at risk. Firearms may also be accidentally deployed or may be difficult to retrieve from their holster or a safety housing under the threat of an attack. There are also other non-lethal tools for self-defense, such as mace or pepper spray. While a pepper spray canister does not typically require substantial strength or skill, users can sometimes accidentally spray themselves rather than their attacker, thus temporarily blinding and incapacitating themselves. Use of pepper spray in enclosed spaces, such as an automobile or a small room, can also hurt the person seeking to defend themself and/or others from an attack, and not just the attacker. These self-defense tools may suffer from victim hesitancy to use them and may also fail to be a sufficiently powerful deterrent.

An assailant will often seek to benefit from the element of surprise and move quickly to a position that is close in front of an intended victim. Under these conditions, the victim must quickly, almost instantaneously, mount an effective defense to avoid being harmed.

Accordingly, there is a need for a self-defense tool that can be hidden from potential attackers, while also being easily accessed by the user of the tool.

SUMMARY

According to aspects of the present disclosure, exemplary embodiments include a personal defense tool including a plurality of rings for receiving a user's fingers, and a plurality of piercing elements extending from the plurality of rings. Each of the piercing elements includes a first end connected to the plurality of piercing elements, a second end spaced apart from the first end and configured to pierce a skin surface, and an arcuate surface extending between the first and second ends.

According to further aspects of the present disclosure, exemplary embodiments include a hair styling tool including a gripping structure, a plurality of metallic piercing elements, and a plastic sheath enclosing the plurality of metallic piercing elements therein. The gripping structure includes a plurality of rings configured for receiving a user's fingers. The metallic piercing elements extend from the gripping structure and each metallic piercing element includes a first end extending from the gripping structure, a second end configured to pierce a skin surface, a convex top surface extending along a length of the metallic piercing element, and a concave bottom surface extending along the length of the metallic piercing element.

According to further aspects of the present disclosure, exemplary embodiments include a personal defense tool including a gripping structure, a middle piercing element, a first outer piercing element, and a second outer piercing element. The gripping structure includes a plurality of rings configured for receiving a user's fingers. The middle piercing element extends from a central ring of the plurality of rings and has a convex top surface extending along a length thereof, and a concave bottom surface extending along the length thereof. The middle piercing element may have an oblique end surface. The first outer piercing element is positioned adjacent a first side of the middle piercing element and extends from the gripping structure. The first outer piercing element has a convex top surface extending along a length thereof, and a concave bottom surface extending along the length thereof. The second outer piercing element is positioned adjacent a second side of the middle piercing element and extends from the gripping structure. The second outer piercing element has a convex top surface extending along a length thereof, and a concave bottom surface extending along the length thereof.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
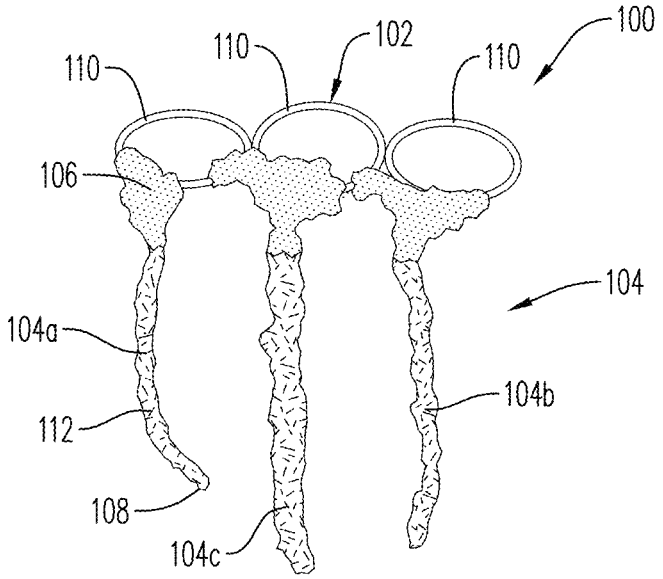
FIG. 1 is a top, perspective view of a personal defense tool, according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

Embodiments of the disclosure may be associated with a personal defense tool that is generally configured as a hair styling tool. The defense tool may be a hair comb that is not only configured to hold hair in place, but also configured as a defensive weapon during an assault or an attack. The defense tool includes quills or piercing elements that may be made from a composite of plastic and metal. The composite may help to strengthen the defense tool. Loops may be provided for a user to easily use the tool as a hair styling tool and also hold and use the tool defensively. The loops may help to provide secure removal from the user's hair as well as provide a secure grip in the event of an attack. The defense tool is configured so that it holds onto and retains a user's hair in stylish positions, while providing for swift removal from the user's hair and deployment into a strike position.

Figure 2:
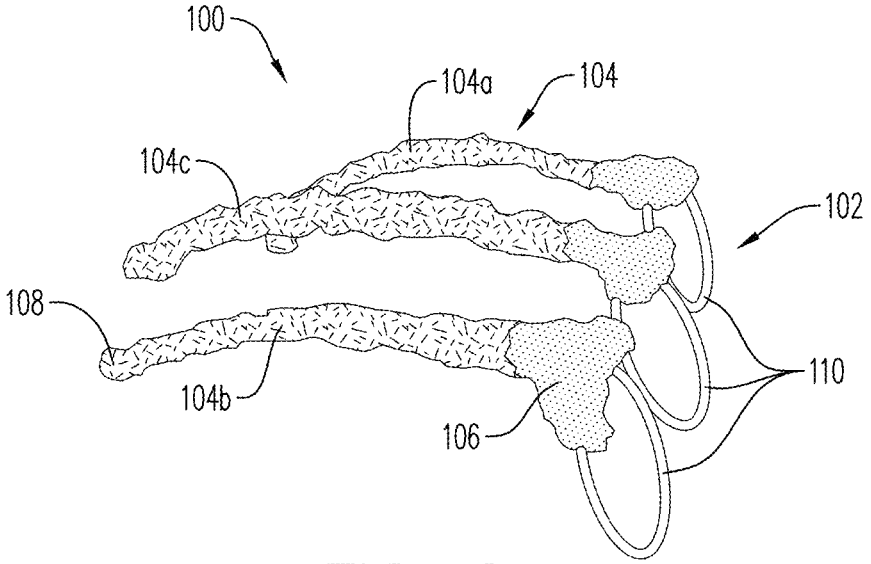
FIG. 2 is a side, perspective view of the personal defense tool of FIG. 2.

FIGS. 1 and 2 illustrate a personal defense tool 100, according to an embodiment. The personal defense tool 100 includes a gripping structure 102 or surface. The gripping structure 102 may be sufficiently contoured so that it facilitates an easy pull to either engage or disengage the defense tool 100 from the user's hair or from an attacker. One pull may disengage the defense tool 100 from a user's hair, making it an easily accessible defense tool.

According to an aspect, the gripping structure 102 includes a plurality of rings 110, each configured for receiving a user's finger. The gripping structure 102 may have a width that is able to span across a user's fingers. According to an aspect, the gripping structure 102 may have a width of up to about 3 inches, alternatively up to about 2.5 inches. While FIGS. 1 and 2 each depict three rings 110, it is contemplated that two rings or more than three rings 110 may be provided. Each ring 110 may have an inner diameter of about 0.75 inch. It is contemplated that the size of each ring 110 may be adjustable to accommodate hands (or fingers) of different size. For example, each ring 110 may be manufactured so that it is able to receive fingers of a particular outer diameter. The ring 110 that receives a user's middle finger may have an inner diameter that is larger than the size of the ring 110 or rings 110 configured to receive a user's ring finger, pointer finger or smallest (pinky) finger.

The personal defense tool 100 further includes a plurality of piercing elements 104 (e.g., prongs or quills) extending from the gripping structure 102. Each piercing element 104 of the plurality of piercing elements 104 extends from one ring 110 of the plurality of rings 110. The plurality of piercing elements 104 may extend from the gripping structure 102 at an angle of less than about 180 degrees, as measured from a connected end 106 of the piercing elements 104 and/or a piercing end 108 of the piercing elements 104. According to an aspect, the plurality of piercing elements 104 may extend from the gripping structure 102 at an angle of less than about 160 degrees, such as, for example, from about 100 degrees to about 160 degrees.

Each piercing element 104 of the plurality of piercing elements 104 may include a first or connected end 106 and a piercing end 108 spaced apart from the connected end 106. As used herein, the term "connected" means associated or related in a manner that brings an item in contact with another. The connected end 106 may be adjacent to the gripping structure 102. According to an aspect, the connected end 106 may be connected with the gripping structure 102 by another mechanism, such as a material that forms a joint between the gripping structure 102 and the connected end 106. According to an aspect, the gripping structure 102 and the piercing element 104 may be integrally formed, such that the connected end 106 extends from and is integrally connected to the gripping structure 102. The piercing end 108 of the piercing element 104 may be configured to retrieve a sample of organic material from an attacker. In some aspects, retrieval of the organic sample may be simultaneous with damaging the attacker during personal defense. For example, the outer surface of the piercing element 104 may have surface features (not explicitly shown) that receives and retains the organic material. Such surface features may be microscopic contours or pockets within which the organic material is retained. In aspects, the surface features may include surface-texturing, knurling, dimpling, surface roughening, etching, or the like. The surface features are configured to enable the organic material to be obtained by law officers to help to identify an attacker or confirm the identity of an attacker. It is contemplated that the surface features may be invisible to the naked eye and may be integrated with the piercing element 104 so that the defense tool 100 can be easily used as a hair style tool that does not snag or get caught on the user's hair. According to an aspect, blood from an attacker may be retained on the surface of the piercing element 104 and provide sufficient DNA material to be tested by law enforcement professionals.

According to an aspect, the connected end 106 of the piercing element 104 has a first diameter and the piercing end 108 has a second diameter. The second diameter may be smaller than the first diameter so that the piercing end 108 may be able to penetrate a surface. According to an aspect, the piercing end 108 may include a pointed edge that aids in the piercing element 104 being able to penetrate a surface.

According to an aspect, at least one piercing element 104 of the plurality of piercing elements 104 has an arcuate configuration along a length thereof. The arcuate configuration of the piercing element 104 may help with placement of the defense tool 100 in the user's hair, while also helping to enhance the comfort of the user of the defense tool 100 as a hair styling tool. For example, the arcuate configuration may allow the piercing elements 104 to contour in close proximity to the user's head (e.g. skull shape).

Figure 7A:
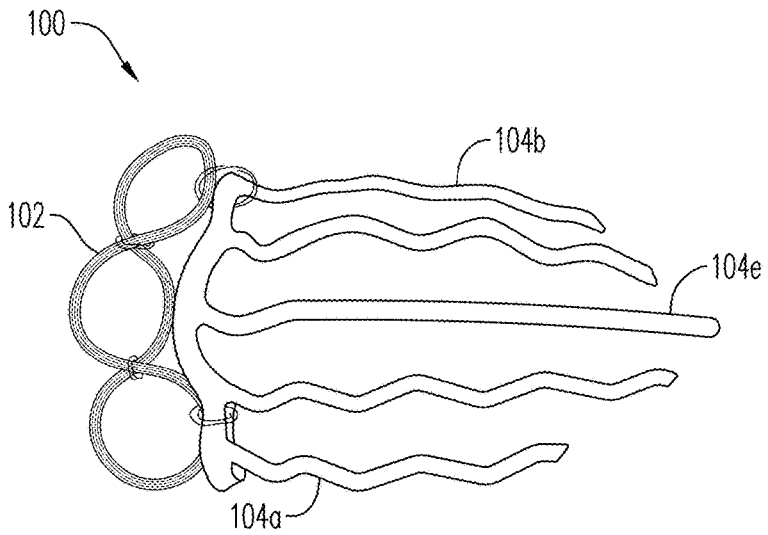
FIG. 7*a* is a top, perspective view of a personal defense tool, according to an embodiment.

According to an aspect and as shown in at least FIG. 7*a*, at least one of the piercing elements, such as, for example, the middle piercing element 104*c* may have at least a portion with a generally planar or straight configuration, while the remaining piercing elements 104*a*, 104*b* may have a wavy or undulating shape. The wavy shape may help to retain the defense tool 100 in a user's hair, and the planar configuration may help to enhance the ease of insertion or removal of the defense tool 100 from the user's hair.

As shown in FIGS. 1 and 2, the plurality of piercing elements 104 may include at least three (3) piercing elements 104, namely, a first outer piercing element 104*a*, a second outer piercing element 104*b*, and an inner piercing element 104*c*. The first outer piercing element 104*a* has a first length, the second outer piercing element 104*b* has a second length, and the inner piercing element 104*c* has a third length. The third length may be greater than each of the first length and the second length. According to an aspect, the first outer piercing element 104*a* and the second outer piercing element 104*b* each have a length of about 2.5 inches to about 3 inches in length, alternatively about 2.5 inches to about 2.75 inches in length. According to an aspect, the inner piercing element 104*c* has a length of about 3 inches to about 3.25 inches.

Figure 3:
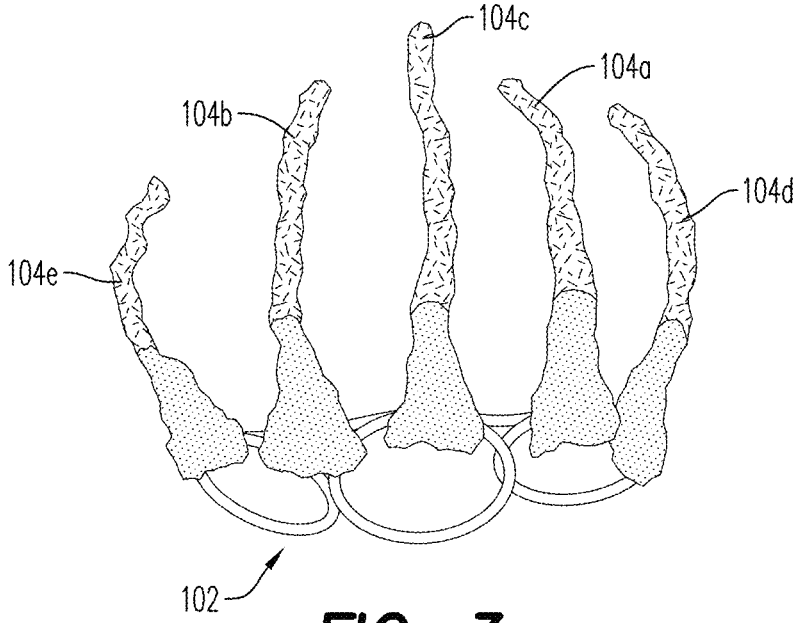
FIG. 3 is a top, perspective view of a personal defense tool, according to an embodiment.
Figure 4:
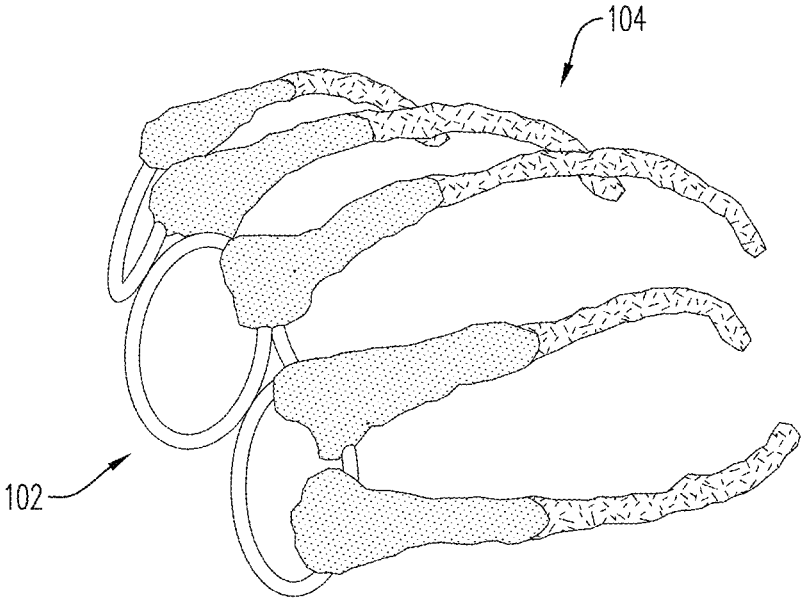
FIG. 4 is a side, perspective view of the personal defense tool of FIG. 3.

FIGS. 3 and 4 illustrate an embodiment in which the defense tool 100 includes five piercing elements 104*a*, 104*b*, 104*c*, 104*d*, 104*e*. The piercing elements 104 include a middle piercing element 104*c* having a length that is greater than the length of each of the other four piercing elements 104*a*, 104*b*, 104*d*, 104*e*. In addition to the middle piercing element 104*c*, the defense tool 100 may include a first outer piercing element 104*d*, a second outer piercing element 104*e*, a first intermediate piercing element 104*a*, and a second intermediate piercing element 104*b*. In some embodiments, the first outer piercing element 104*d*, the second outer piercing element 104*e*, the first intermediate piercing element 104*a*, and the second intermediate piercing element 104*b* may be approximately equal in length. In other embodiments, the first intermediate piercing element 104*a* and the second intermediate piercing element 104*b* may have a length greater than that of the first outer piercing element 104*d* and the second outer piercing element 104*e*. In some embodiments, the first intermediate piercing element 104*a* and the second intermediate piercing element 104*b* may have a length which is approximately equal to each other. In some embodiments, the first intermediate piercing element 104*a* and the second intermediate piercing element 104*b* may have a length which is different from each other. In some embodiments, the first outer piercing element 104*d* and the second outer piercing element 104*e* may have a length which is approximately equal to each other. In some embodiments, the first outer piercing element 104*d* and the second outer piercing element 104*e* may have a length which is different from each other.

According to an aspect, the first outer piercing element 104*d* and the second outer piercing element 104*e* each have a length of about 2 inches, while the middle piercing element 104*c* has a length of about 3 inches. According to an aspect, a first intermediate piercing element 104*a* is positioned between the first outer piercing element 104*d* and the middle piercing element 104*c*, and has a length ranging from about 2 inches to about 2.5 inches. A second intermediate piercing element 104*b* may be positioned between the second outer piercing element 104*e* and the middle piercing element 104*c*, and may have a length ranging from about 2 inches to about 2.5 inches. At least one of the first intermediate piercing element 104*a* or the second intermediate piercing element 104*b* may extend from a point of physical connection between adjacent rings 110 of the gripping structure 102. Other configurations are contemplated. For example, at least one of the first intermediate piercing element 104*a* or the second intermediate piercing element 104*b* may extend from any position on one of the rings 110 of the gripping structure 102.

One or more components of the defense tool 100 may include a reinforced material. It is contemplated that only the connected end 106 and/or the piercing end 108 may include the reinforced material. According to an aspect, at least one piercing element 104 of the plurality of piercing elements 104 includes the reinforced material. The reinforced material may include a metal-reinforced plastic. According to an aspect, the plurality of piercing elements 104 is formed from a composite of woven metal and plastic. The plurality of piercing elements 104 may be formed from a metallic mesh that is covered by plastic.

Figure 5:
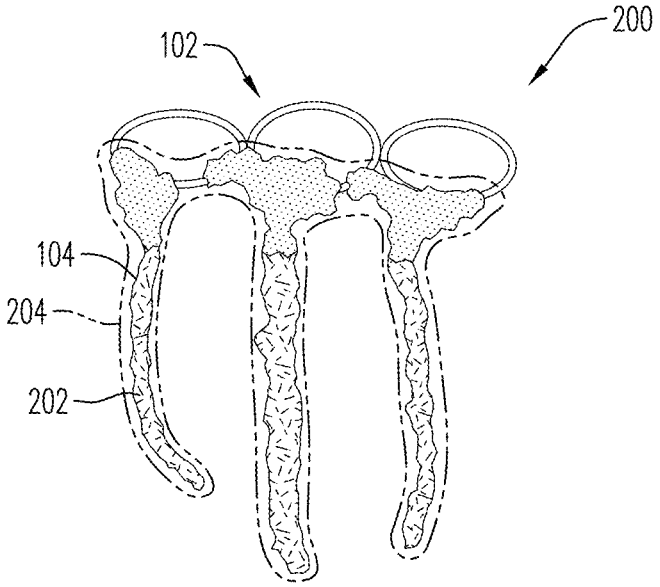
FIG. 5 is a top, perspective view of a personal defense tool, according to an embodiment.
Figure 6:
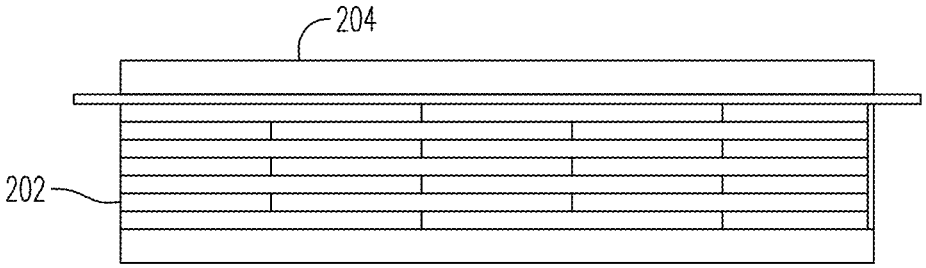
FIG. 6 is a cross-sectional view of a section of a piercing element of the personal defense tool of FIG. 5.

With reference to FIGS. 5 and 6, according to an aspect, another embodiment of a defense tool 200 is provided that generally includes a core 202 and a shell, casing, overmold, or sheath 204 in which the core 202 is housed or surrounded. The core 202 may include a plurality of piercing elements 104, similar to the piercing elements 104 of FIGS. 1-4. The core 202 may be made from a metallic material (e.g., a metal mesh or a solid metal) and is configured to help to provide strength, stability and/or rigidity for the defense tool 200. The sheath 204 may be fabricated from a plastic, such as, for example, a polymer extending around the core 202 to allow the defense tool 200 to have the alternative function as a hair accessory by providing smoothness for insertion and removal from the user's hair and/or providing a safe exterior for use as a hair accessory to protect a user's scalp from damage when used as a hair accessory. As such, the metal core 202 is more rigid than the sheath 204. In aspects, the sheath 204 may be overmolded or insert molded to the core 202 such that the plastic material of the sheath 204 surrounds the core 202 while infiltrating any spaces or pores in the core 202 such that the sheath 204 is integrated into the core 202. The polymer may also disguise the weapon as a beautiful hair accessory, providing privacy for the user of the defense tool 100 and hiding the self-defense nature of the tool until the user chooses to reveal it. Decorative items, such as jewels may be included on, for example, the gripping structure 102 of the defense tool 100. According to an aspect, cellulose acetate may extend around the core 202. The plastic sheath 204 may only extend around the piercing elements 104 such that the gripping structure 102 of the personal defense tool 200 is exposed and accessible by a user.

In aspects, the plurality of piercing elements 104 may be removable from the sheath 204. For example, the piercing elements 104 and the gripping structure 102 may be an integral unit, with the piercing elements being configured to be retained within a separate sheath 204. A user might then unsheathe the piercing elements 104 by pulling on the gripping structure 102 while holding the sheath 204. In such embodiments, the tool with sheathed core 204 may be configured for use as a hair accessory, while the unsheathed core 204 may be configured for use as a self-defense tool.

FIG. 6 illustrates a cross-sectional view of one of the metal piercing elements 104 of FIG. 1, in which the skeletal frame or core 202 is sandwiched between the polymer sheath 204. The core 204 may include a metal that adds rigidity to the piercing element 104, while the polymer 202 provides a smooth surface, additional rigidity and/or privacy as to the ability for the defense tool 100 to be used as a versatile hair styling tool and defense weapon.

In further embodiments, it is contemplated that the defense tool 100 may be configured as a stylish and functional hair comb for holding hair in place as a style comb, as well as for combing hair and as a self-defense tool. When used as a self-defense tool, the defense tool 100 is suitable for striking and impaling an attacker. One or more parts of the defense tool 100 may be made from at least one of aluminum, glass filled nylon, or sugar cane bagasse. It is contemplated that the defense tool 100 may be made by an injection molding process that includes materials suitable for injection molding tools.

Figure 7B:
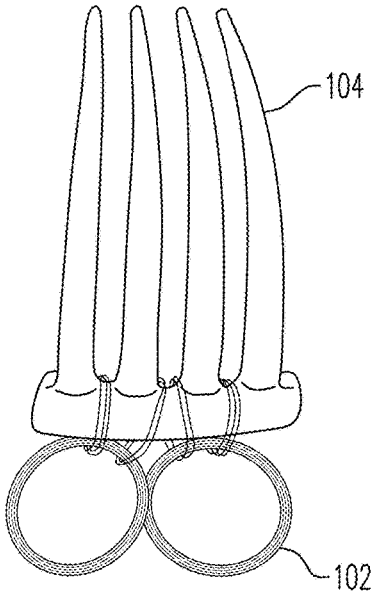
FIG. 7*b* is a top, perspective view of a personal defense tool, according to an embodiment.
Figure 7C:
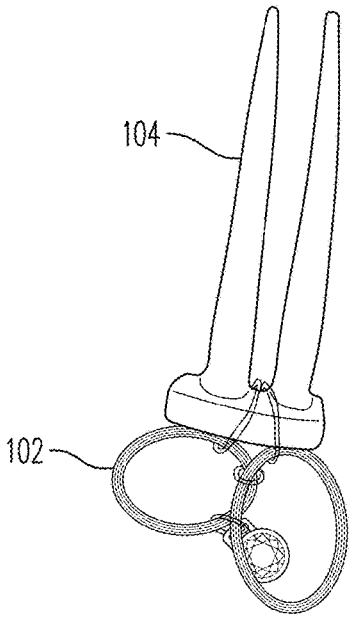
FIG. 7*c* is a top, perspective view of a personal defense tool, according to an embodiment.

According to an aspect and as illustrated in FIGS. 7*a*-7*c*, the gripping structure 102 may be made of a metal while the piercing elements 104 may be made from a material other than metal. It is contemplated that the entire defense tool 100 may include a nonmetal core. In this configuration, the defense tool 100 will not set off metal detectors since it includes no metal. The gripping structure 102 has a plurality of rings or openings 110 to facilitate ease in holding and placing the defense tool 100 into and out of the user's hair. These rings or openings 110 also allow the user to securely hold the defense tool 100 as a weapon, should they need to. The defense tool 100 can also be conveniently kept in a user's personal bag, such as purse, wallet or a backpack to be available in the event of an attack. It is contemplated that the defense tool 100 may also be worn in a user's hair to provide ease of access.

Figure 8:
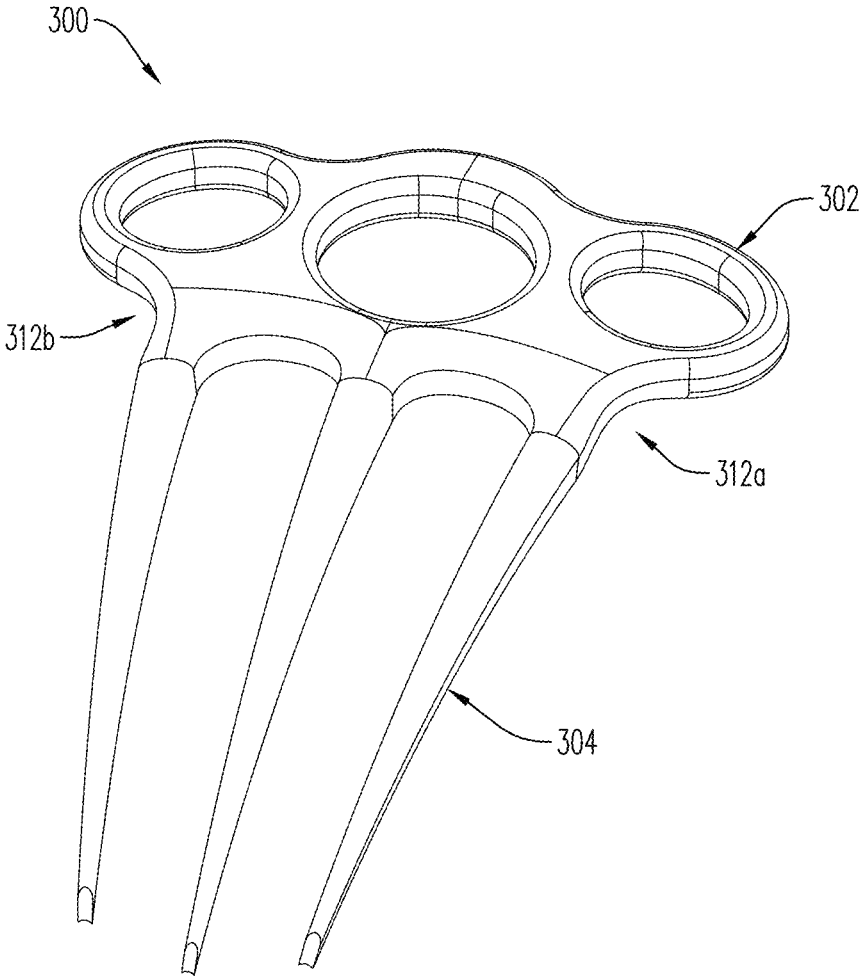
FIG. 8 is perspective view of a personal defense tool, according to an embodiment.
Figure 9:
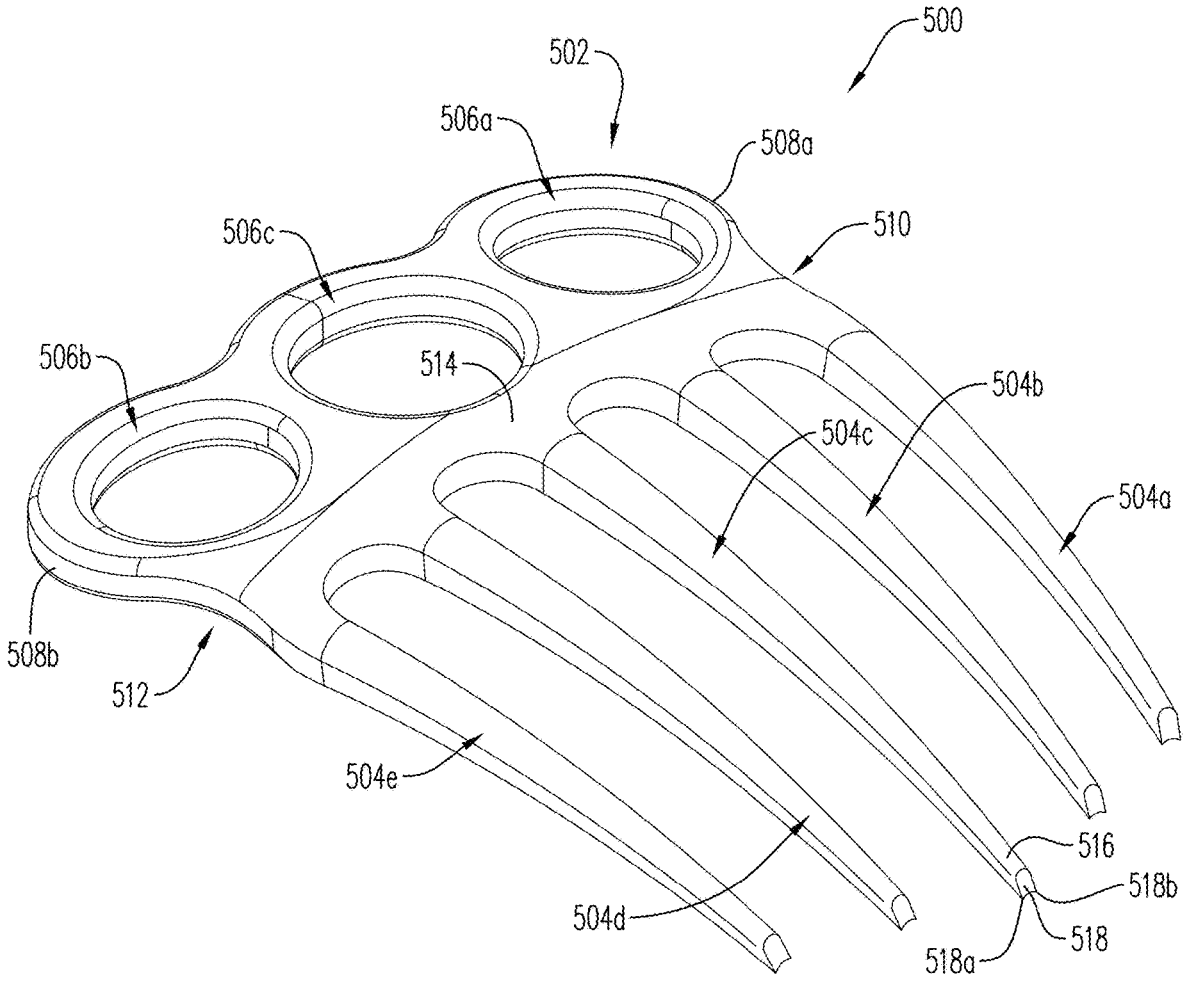
FIG. 9 is a top, perspective view of a personal defense tool, according to an embodiment.
Figure 10:
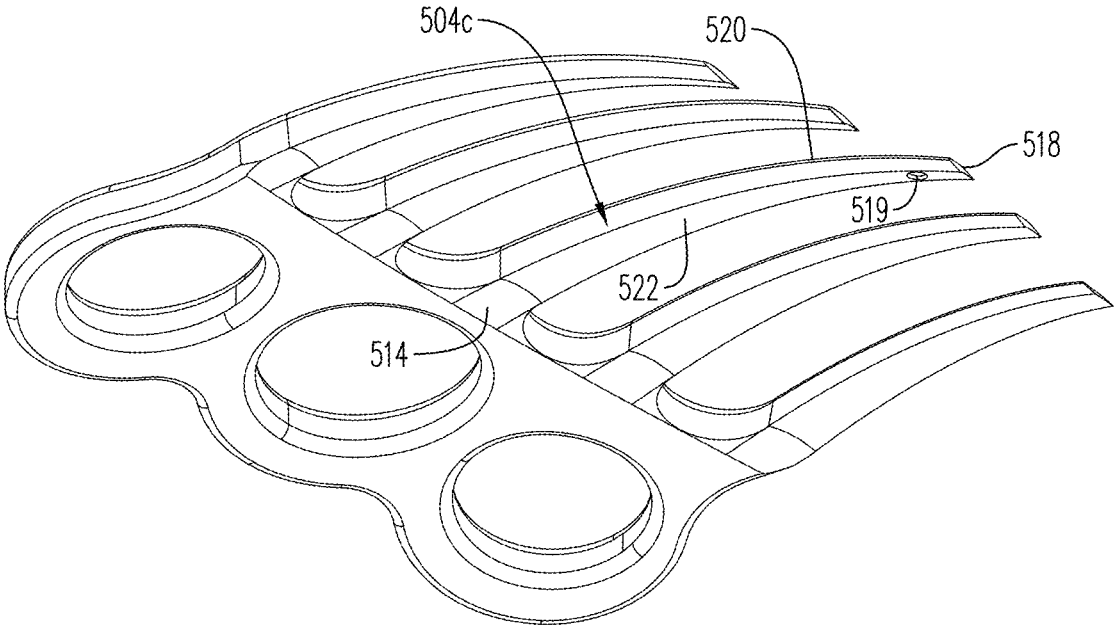
FIG. 10 is a bottom, perspective view of the personal defense tool of FIG. 9.
Figure 11:
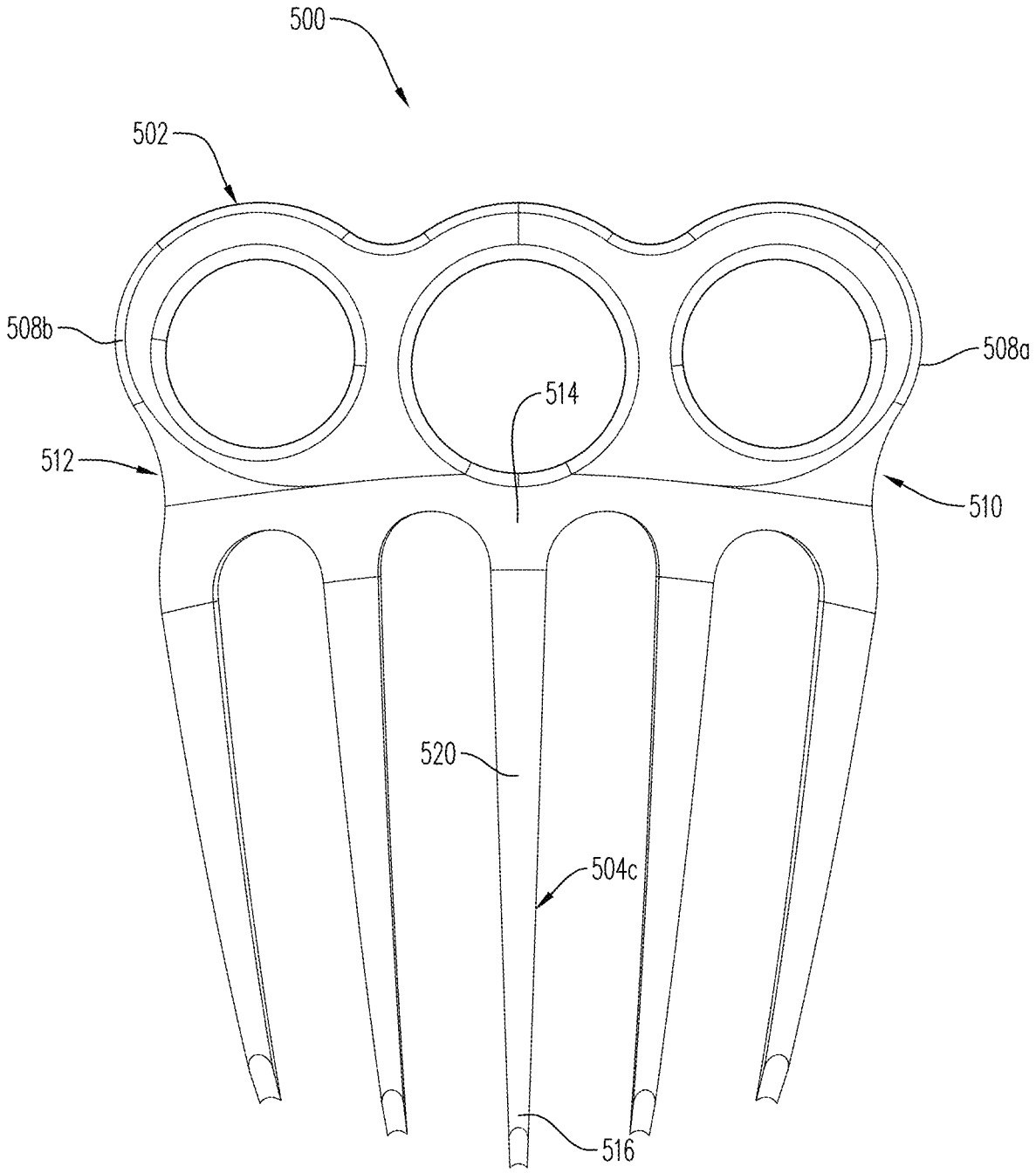
FIG. 11 is a top view of the personal defense tool of FIG. 9.

As illustrated in FIG. 8, another embodiment of a personal defense tool 300 is provided, similar to the personal defense tool 100. The personal defense tool 300 may be monolithically formed from a plastic and generally includes a gripping structure 302 having a plurality of openings defined therethrough, and a plurality (e.g., three) prongs or piercing elements 304 extending from the gripping structure 302. The gripping structure 302 includes a pair of indentations 312*a*, 312*b* positioned adjacent respective outermost piercing elements 304*a*, 304*b* of the plurality of piercing elements 304. According to an aspect, the indentations 312*a*, 312*b* are configured to provide a surface within which the user can position their thumb and pinky fingers, thereby enhancing the comfortable use of the defense tool 300.

With reference to FIGS. 9-12, another embodiment of a personal defense tool 500, such as, for example, a weaponized comb, is provided, similar to the personal defense tool 100. The personal defense tool 500 includes a gripping structure 502 and a plurality of prongs or piercing elements 504*a*, 504*b*, 504*c*, 504*d*, 504*e* extending from the gripping structure 502. The gripping structure 502 and the piercing elements 504*a*-504*e* may be monolithically formed from a plastic or a metal. In aspects, the piercing elements 504*a*-504*e* may be attached to the gripping structure 502 via a suitable fastening engagement, such as, for example, adhesive, soldering, or the like. In aspects, the piercing elements 504*a*-504*e* may be fabricated from a first material (e.g., metal) whereas the gripping structure 502 may be fabricated from a second material (e.g., plastic).

The gripping structure 502 includes a plurality of rings 506*a*, 506*b*, 506*c*, each configured for receiving a user's finger. The gripping structure 502 may be planar or substantially planar (e.g., a plate) and the plurality of rings 506*a*, 506*b*, 506*c* may be oriented in a linear array within a plane of the gripping structure 502. The gripping structure 502 has a first peripheral edge portion 508*a* positioned adjacent a first outer-most piercing element 504*a*, and a second peripheral edge portion 508*b* positioned adjacent a second outer-most piercing element 504*e*. The first peripheral edge portion 508*a* defines a first indentation 510 therein and the second peripheral edge portion 508*b* defines a second indentation 512 therein. The first indentation 510 may be configured for accommodating a user's pinky and the second indentation 512 may be configured for accommodating a user's thumb.

The piercing elements 504*a*-504*e* may include the first and second outer-most piercing elements 504*a*, 504*e*, first and second inner or intermediate piercing elements 504*b*, 504*d* positioned inwardly of the first and second outer-most piercing elements 504*a*, 504*e*, and a middle piercing element 504*c* positioned between the first and second intermediate piercing elements 504*a*, 504*b*. The middle piercing element 504*c* may extend from the central ring 506*b* at a perpendicular angle relative to a longitudinal axis of the gripping structure 502. The middle piercing element 504*c* may have a length that is greater than a length of each of the other piercing elements 504*a*, 504*b*, 504*d*, 504*e*. The first outer-most piercing element 504*a* and the first intermediate piercing elements 504*b* may extend from the first ring 506*a* at an angle less than 90 degrees such that free ends of the piercing elements 504*a*, 504*b* are closer to the middle piercing element 504*c* than a connected end 514 thereof. For example, each of the first outer-most piercing element 504*a* and the first intermediate piercing element 504*b* may angle or curve towards middle piercing element 504*c* as they extend outward from their proximal end (e.g., the connected end) towards their distal end (e.g. the free end). Similarly, the second outer-most piercing element 504*e* and the second intermediate piercing elements 504*d* may extend from the third ring 506*b* at an angle less than 90 degrees such that free ends of the piercing elements 504*d*, 504*e* are closer to the middle piercing element 504*c* than a connected end 514 thereof.

Since the piercing elements 504*a*-504*e* are identical or substantially similar, only details regarding certain features of the middle piercing element 504*c* will be described in detail herein. The middle piercing element 504*c* has a first or connected end 514 formed with or attached to the central ring 506*c* of the gripping structure 502, and a second or free end 516. The first end 514 may have a width from about 0.2 inches to about 0.3 inches, and in some aspects, about 0.222 inches. In aspects, the tip or free end 516 may have a width from about 0.07 inches to about 0.15 inches, and in some aspects about 0.09 inches. In aspects, the adjacent piercing elements (e.g., piercing elements 504*a*, 504*b*) of the plurality of piercing elements 504*a*-504*e* may be spaced between one another by a distance from about 0.4 inches to about 0.6 inches, and in some aspects, about 0.5 inches. The distance between adjacent piercing elements 504*a*-504*e* may decrease along the length of the piercing elements in a direction from the connected end 514 to the tip 516.

The tip or free end 516 of the middle piercing element 504*c* may have an oblique end surface 518 configured to puncture through clothing and a skin surface of the attacker. The oblique end surface 518 may extend from a top surface 520 of the tip 516 to a bottom surface 522 of the tip 516 at an obtuse angle, such as, for example, from about 100 degrees to about 170 degrees, and in some aspects, about 120 degrees. In aspects, the oblique end surface 518 may be configured to pierce through a variety of clothing and materials with a threshold puncturing force without breaking or compromising the integrity of the piercing elements 504*a*-5043. In aspects, the edge surface 518 may be sharp or pointed. In aspects, the free end 516 may define a slot, dimple, pocket or depression 519 (FIG. 10) therein configured to retrieve a sample of organic material therein upon the free end 516 puncturing a skin surface. In aspects, the free end 516 of the middle piercing element 506 may have one or more surface features, such as, for example, knurling, surface texturing, serrations, surface etchings, or the like, to facilitate capturing organic material.

The middle piercing element 504*c* may have an arcuate shape along its length such that the middle piercing element 504*c* has a convex top surface 520 extending along the length thereof, a pair of flat, lateral sides 523, 525, and a concave bottom surface 522 (e.g., the concavity is defined in the width direction between the lateral sides 523, 525). In aspects, the convex top surface 520, the flat, lateral sides 523, 525, and the concave bottom surface 522 may be defined along an entire length of the piercing elements or only at the tips of the piercing elements. This design has proven to add enough strength and integrity to the piercing elements to enable penetration of the piercing elements through an attacker's clothing (e.g., shirts, sweatshirts, jean pants, etc.) and into an attacker's skin without breaking or deforming the piercing elements.

Figure 12:
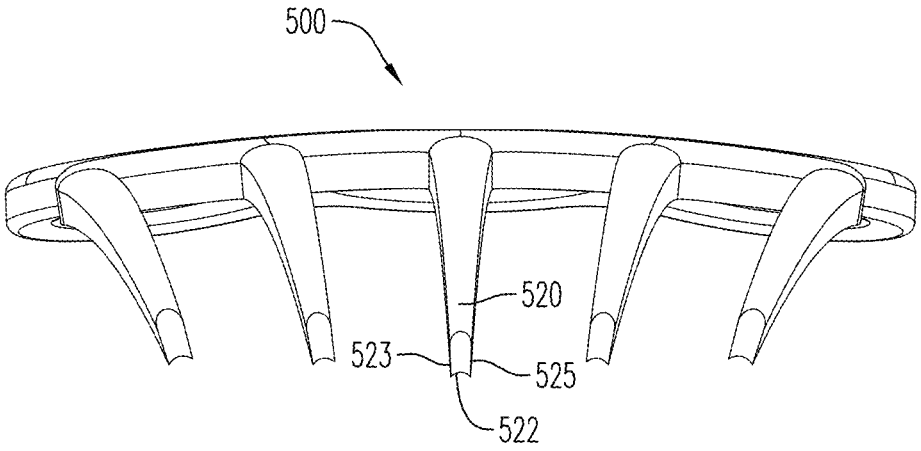
FIG. 12 is a front view of the personal defense tool of FIG. 9.

In aspects, as best shown in FIG. 12, the concave bottom surface 522 may be concave along a length of the piercing element 504*c* (e.g., between the connected end 514 to the free end 516) and along a width of the piercing element 504*c* (e.g., between the pair of flat, lateral sides 523, 525). The radius of the concave bottom surface 522 may be from about 0.25 inches to about 0.4 inches, and in some aspects, about 0.35 inches. The first lateral side 523 and the concave bottom surface 522 intersect to define a first point 518*a* of the tip 516, and the second lateral side 525 and the concave bottom surface 522 intersect to define a second point 518*b* of the tip 516. In aspects, the points 518*a*, 518*b* may be configured as barbs, tangs, fangs, or the like configured to facilitate penetration of the tips 516 through clothing.

In some embodiments, the connected end 514 may be thicker than the free end 516, for example with the top surface 504*c* curving more than the bottom surface 522. In aspects, the top surface 520 of the middle piercing element 504*c* may have an arcuate transverse cross-sectional shape and the bottom surface 522 may have a flat or squared-off transverse cross-sectional shape. The middle piercing element 504*c* may taper in diameter along the length thereof in a direction from the first end 514 toward the second end 516. In aspects, the personal defense tool 500 may be continuously curved along an entire length thereof, for example, from a proximal-most end of the gripping structure 502 to the free, distal ends of the piercing elements 504*a*-504*c*

In aspects, a plastic casing or sheath (not explicitly shown) may be provided, similar to the polymer sheath 204 of FIG. 5. The plastic sheath includes a plurality of hollow prongs configured for receipt of the respective piercing elements 504-504*e*. The hollow prongs may each have a blunt or atraumatic free end that function solely to facilitate combing of a user's hair without having the potential of puncturing a skin surface. It is contemplated that the plastic sheath may leave the gripping structure 502 exposed to allow a user to insert their fingers into the rings 506*a*, 506*b*, 506*c* and withdraw the personal defense tool 500 from the plastic sheath while the plastic sheath remains within a user's hair.

Figure 13:
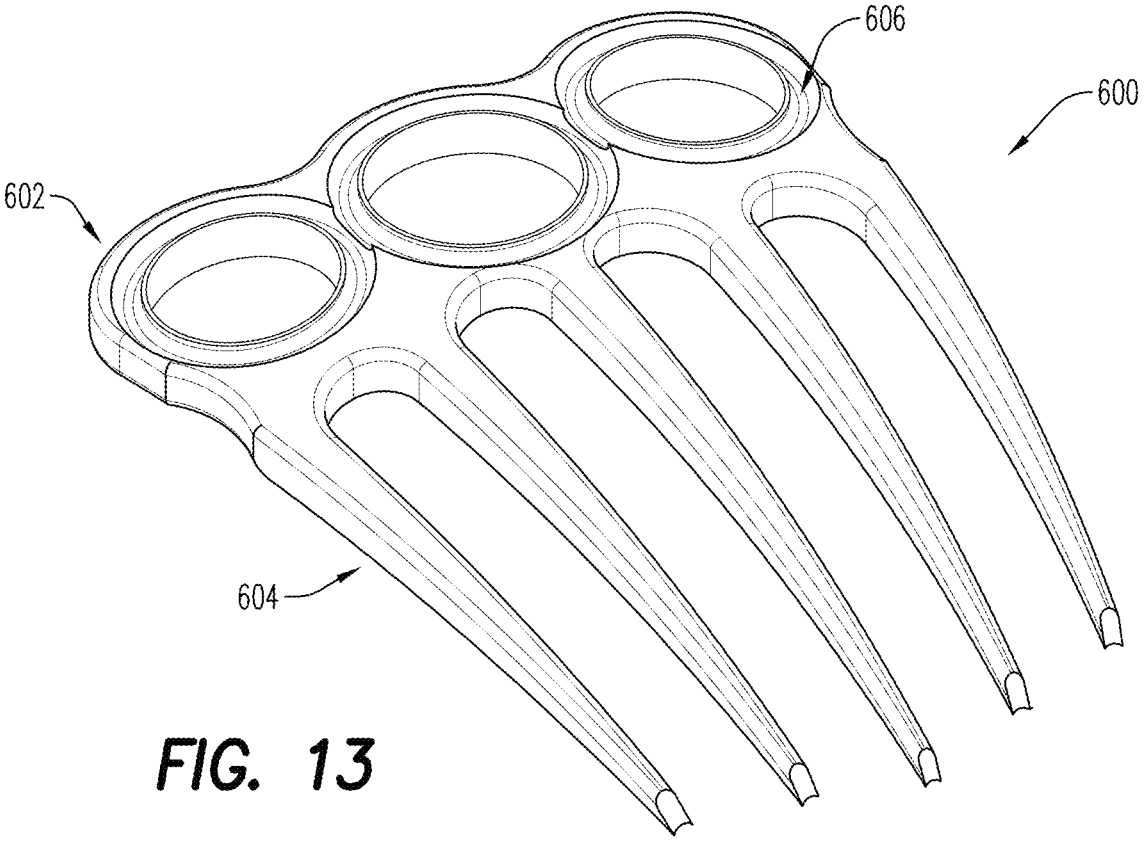
FIG. 13 is a top view illustrating another embodiment of a personal defense tool including inlays.

With reference to FIG. 13, another embodiment of a personal defense tool 600, such as, for example, a weaponized comb, is provided, similar to the personal defense tool 100. The personal defense tool 600 includes a gripping structure 602 and a plurality of prongs or piercing elements 604 extending from the gripping structure 602. The gripping structure 602 has a top surface defining a shallow depression 606 therein of a suitable pattern. The depression 606 is configured for receipt of a suitable decorative feature, such as, for example, the beads 708 of FIG. 14. Other types of decorative features are also contemplated, such as gems, stones, diamonds, glitter, etc.

Figure 14:
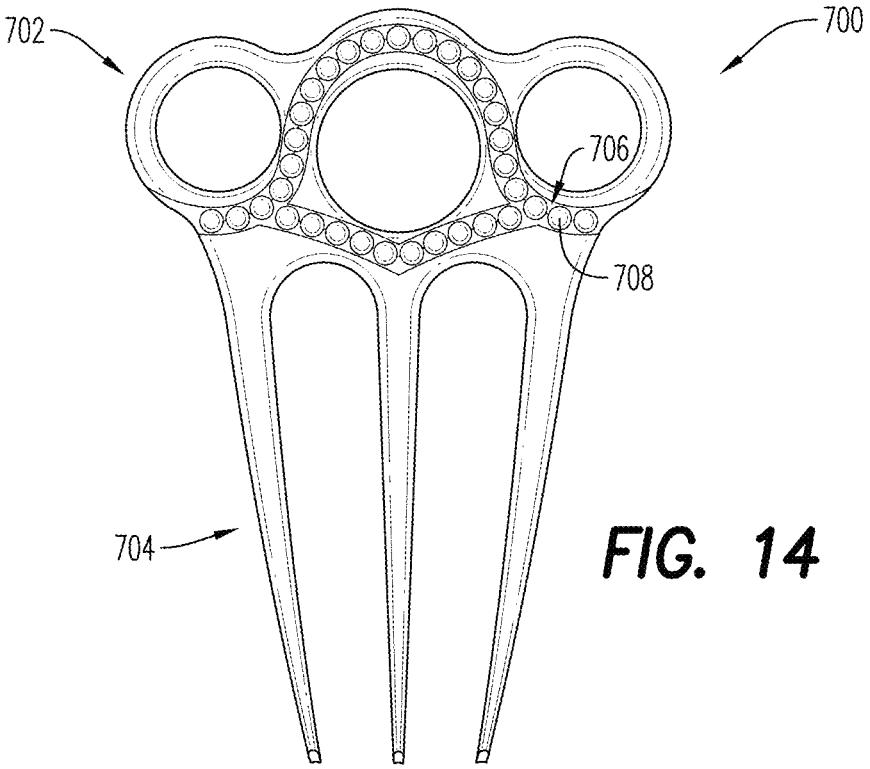
FIGS. 14 and 15 are tops view illustrating another embodiment of a personal defense tool including a plurality of beads.
Figure 15:
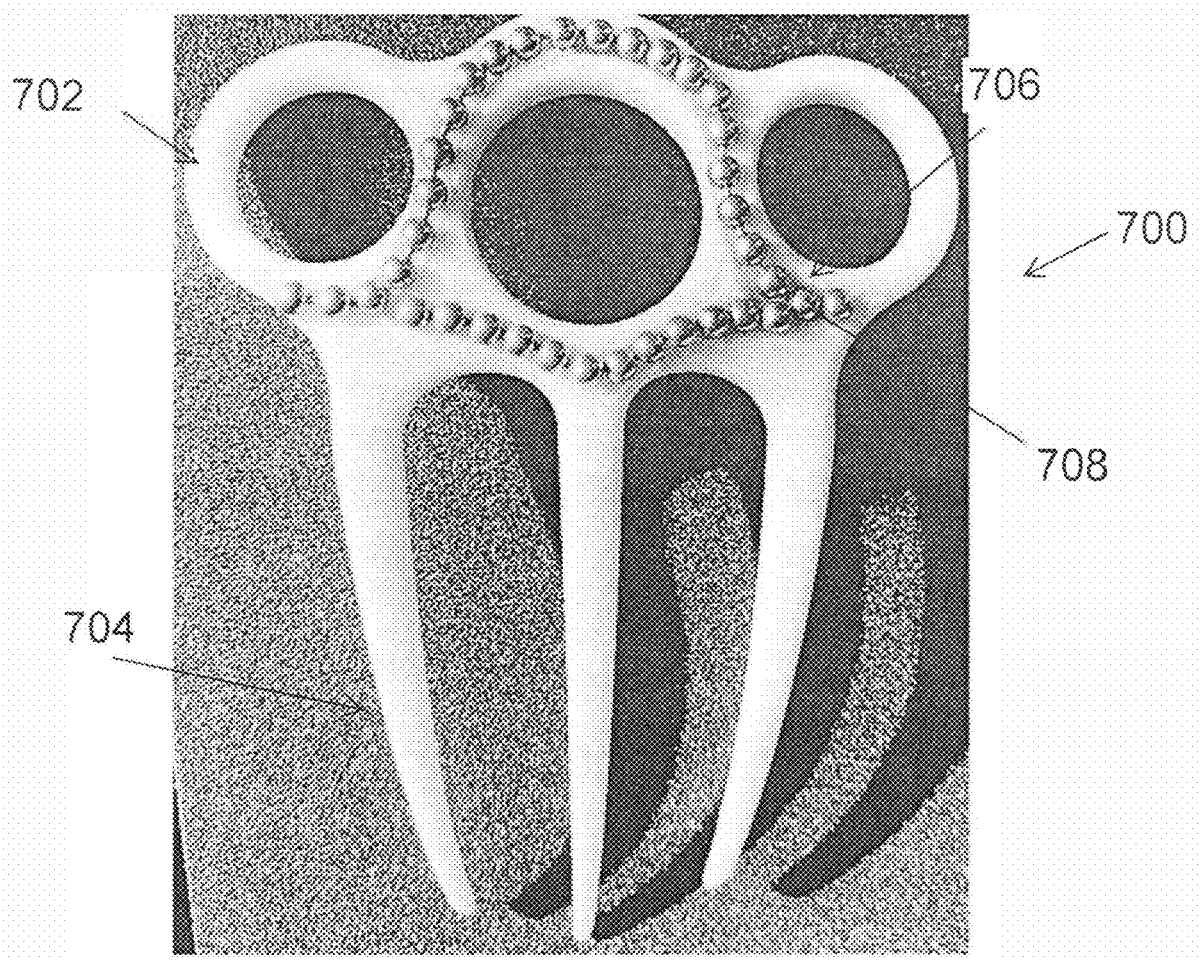

With reference to FIGS. 14 and 15, another embodiment of a personal defense tool 700, such as, for example, a weaponized comb, is provided, similar to the personal defense tool 100. The personal defense tool 700 includes a gripping structure 702 and a plurality of prongs or piercing elements 704 extending from the gripping structure 702. The gripping structure 702 has a top surface defining a shallow depression 706 therein of a suitable pattern. The personal defense tool 700 includes a plurality of decorative features, such as, for example, beads 708 fixed within the depression 706. Other patterns (not shown) for the inlay design are also contemplated.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function;

and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A personal defense tool, comprising:

a plurality of rings for receiving a user's fingers; and a plurality of piercing elements extending from the plurality of rings, each piercing element of the plurality of piercing elements forming an oblique end surface configured to pierce a clothing and skin surface of an attacker, a top surface of the piercing element forming an obtuse angle with the oblique end surface and a bottom surface of the piercing element forming an acute angle with the oblique end surface, wherein the bottom surface providing a surface depression formed therein configured to retrieve and retain a sample of organic material, the plurality of piercing elements further comprises:

a middle piercing element extending perpendicularly from an outer circumference of a middle ring of the plurality of rings;

a first outer piercing element positioned adjacent a first side of the middle piercing element; and a second outer piercing element positioned adjacent a second side of the middle piercing element, the first and second outer piercing elements being angled inwardly toward the middle piercing element in a direction from a first end of each of the plurality of piercing elements to a second end of each of the plurality of piercing elements; and an arcuate surface extending between the first and second ends, wherein the middle piercing element is longer than the first and second outer piercing elements.

2. The personal defense tool of claim 1, wherein the plurality of piercing elements taper in diameter along a length thereof in a direction from a first end extending from the plurality of rings toward a second end spaced apart from the first end and including the oblique end surface.

3. The personal defense tool of claim 1, wherein the plurality of piercing elements is formed from a composite mesh of woven metal and plastic.

4. The personal defense tool of claim 1, further comprising a sheath, the plurality of piercing elements being housed in the sheath.

5. The personal defense tool of claim 4, wherein the plurality of piercing elements are fabricated from a metal, and the sheath is fabricated from a plastic.

6. The personal defense tool of claim 1, wherein each of the piercing elements extends from one ring of the plurality of rings.

7. A hair styling tool, comprising:

a gripping structure including a plurality of rings configured for receiving a user's fingers;

a plurality of piercing elements extending from the gripping structure, including a central piercing element, the central piercing element being the longest piercing element and outer piercing elements are angled inwardly towards the central piercing element, and each piercing element of the plurality of piercing elements further comprises:

an oblique end surface configured to pierce a clothing and skin surface of an attacker, a top surface of the piercing element forming an obtuse angle with the oblique end surface and a bottom surface of the piercing element forming an acute angle with the oblique end surface;

a convex top surface extending along a length of the piercing element; and a concave bottom surface extending along the length of the piercing element; wherein each piercing element comprises a metallic core enclosed in a plastic sheath and the central piercing element extending perpendicularly from an outer circumference of a middle ring of the plurality of rings.

8. The hair styling tool of claim 7, wherein the gripping structure is integrally formed with the plurality of piercing elements.

9. The hair styling tool of claim 7, wherein each piercing element of the plurality of metallic piercing elements tapers in diameter along the length thereof in a direction from a first end toward a second end.

10. A personal defense tool, comprising:

a gripping structure including a plurality of rings configured for receiving a user's fingers;

a middle piercing element extending perpendicularly from an outer circumference of a central ring of the plurality of rings, the middle piercing element having a convex top surface extending along a length thereof, and a concave bottom surface extending along the length thereof, the middle piercing element having an oblique end surface, wherein the top surface of the piercing element forms an obtuse angle with the oblique end surface and the bottom surface of the piercing element forms an acute angle with the oblique end surface;

a first outer piercing element positioned adjacent a first side of the middle piercing element and extending from the gripping structure, the first outer piercing element being shorter than the middle piercing element and angling inwards towards the middle piercing element; and a second outer piercing element positioned adjacent a second side of the middle piercing element and extending from the gripping structure, the second outer piercing element being shorter than the middle piercing element, angling inwards towards the middle piercing element.

11. The personal defense tool according to claim 10, wherein the oblique end surface is at a tip of each of the piercing elements.

12. The personal defense tool according to claim 11, wherein the middle piercing element has a first lateral side and a second lateral side, the concave bottom surface of the middle piercing element has a concave shape extending between the first lateral side and the second lateral side.

13. The personal defense tool of claim 2, wherein the plurality of piercing elements taper in diameter along a length thereof in a direction from the first end toward the second end and is formed from a composite of woven metal and plastic.

14. The personal defense tool of claim 1, wherein the plurality of piercing elements comprise at least five piercing elements.

15. The personal defense tool of claim 7, wherein the plurality of piercing elements comprise at least five piercing elements.

* * * * *